US007450731B2

(12) United States Patent
Barthel

(10) Patent No.: US 7,450,731 B2
(45) Date of Patent: Nov. 11, 2008

(54) HEARING AID DEVICE AND CORRESPONDING OPERATING METHOD

(75) Inventor: Roland Barthel, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 568 days.

(21) Appl. No.: 11/120,596

(22) Filed: May 3, 2005

(65) Prior Publication Data

US 2005/0249372 A1 Nov. 10, 2005

(30) Foreign Application Priority Data

May 4, 2004 (DE) ..... 10 2004 021 964

(51) Int. Cl.
*H04R 25/00* (2006.01)

(52) U.S. Cl. ..... 381/313; 381/312; 381/322; 381/331; 381/356; 455/41.2

(58) Field of Classification Search ..... 381/313, 381/328, 331, 312, 314, 315, 322, 327, 23.1, 381/123, 324, 356; 455/41.2, 74, 66.1
See application file for complete search history.

(56) References Cited

U.S. PATENT DOCUMENTS 3,975,599 A * 8/1976 Johanson ..... 381/313
5,404,407 A 4/1995 Weiss
6,633,645 B2 10/2003 Bren et al.
6,760,457 B1 7/2004 Bren et al.
2002/0197961 A1* 12/2002 Warren ..... 455/66
2003/0152243 A1* 8/2003 Julstrom et al. ..... 381/315

FOREIGN PATENT DOCUMENTS

DE 93 20 391 U1 8/1994
DE 42 33 813 C1 4/1995
EP 0591791 A1 4/1994
WO 0223950 A2 3/2002

* cited by examiner

*Primary Examiner*—Suhan Ni
*Assistant Examiner*—Jesse A Elbin

(57) ABSTRACT

A comfortable device that combines the functionality of a hearing aid with that of a headset is to be provided. A hearing aid device (H) is thus provided which comprises a rotary switch, on which is arranged a directional microphone. In a first rotary position corresponding to the hearing aid mode, the directional microphone points horizontally forwards, whilst in the second rotary position corresponding to a telephone mode, the directional microphone points towards the mouth of the wearer. The hearing aid device is switched into the corresponding mode by rotating the directional microphone.

4 Claims, 2 Drawing Sheets

HEARING AID DEVICE AND CORRESPONDING OPERATING METHOD

CROSS REFERENCE TO RELATED APPLICATIONS

This application claims priority to the German application No. 10 2004 021 964.8, filed May 4, 2004 which is incorporated by reference herein in its entirety.

FIELD OF INVENTION

The present invention relates to a hearing aid device, and particulariy to a hearing aid device for operating in a first operating mode, wherein a directional microphone is pointed horizontally forward, and a second operating mode, wherein the directional microphone is oriented in a downward direction.

BACKGROUND OF INVENTION

As is known, in-the-ear hearing aids are inserted into the auditory canal with the aid of an otoplastic. The microphones in the directional microphone of the hearing aid are arranged such that their highest sensitivity in an inserted state of the hearing aid essentially points horizontally forward.

Furthermore headsets are available on the market, which are used in conjunction with mobile telephones for example. With these devices the telephone signal is transmitted wirelessly or by wire from the telephone to the headset. This is either fixed into the ear using an otoplastic or an ear plug and partially covers the pinna.

SUMMARY OF INVENTION

It would be preferable for some headset wearers if the headset also had a hearing aid functionality. This would be advantageous in that the headset user would also profit from a frequency response shaping of a hearing aid. The problem here however is that the directional microphone must point horizontally forwards in a hearing aid mode and be directed towards the mouth of the user in a telephone mode.

Publication DE 93 20 391 U1 discloses a control mechanism for hearing aids, in particular for switching on/off, for switching from microphone to induction coil operation, for adjusting the volume or as a situation change -over switch for adjusting selectable transmission functions. The control mechanism can be configured in the form of a microswitch as a press switch, push-button switch or rocker switch, or in the form of a small rotary switch, whereby several switch functions can be initiated or several switch positions selected particularly in the design as a switch with a rotatable actuating element.

Furthermore, patent application DE 42 33 813 C1 discloses a programmable hearing aid device with a space-saving arrangement of the switch elements. A control element can thus be inserted into a programming connector for switching the hearing aid on/off. The insertable switch element can be designed as a rotary switch or a potentiometer.

An object of the present invention is thus to specify a hearing aid device, which allows for addressing these problems. Furthermore, a corresponding method for operating a hearing aid is to be specified.

According to the invention, this object is achieved by the claims.

Advantageously the control function can be combined with the alignment process of the directional microphone, thus avoiding a compromise, according to which the directional microphone would be arranged in a fixed central position between the horizontal and the direction to the mouth of the user.

In the second operating mode, signals can also preferably be amplified by the directional microphone device. This is not only necessary in the case of binaural supply, but also brings essential advantages for the hearing-impaired, since it expediently amplifies their own speech.

The second operating mode can be a telephone mode, the electrically or electromagnetically transmitted signals originating from a telephone. Although simple switching into the telephone mode will represent a principle application area, the method according to the invention and the hearing aid device according to the invention can however also be used to transmit just the user's own voice signals to an external amplifier. This is suited for example to events in large rooms, television broadcasts and the like. In any case, the wearer in the second mode can also profit from the hearing aid functionality and, if necessary, switch into the pure hearing aid operation by means of a simple rotation of the directional microphone.

In an advantageous embodiment of the hearing aid device according to the invention, the transmission device has a Bluetooth-chip, which enables standard transmission methods to be used.

There can be further advantages in enabling the transmission device to be switched to inactive in the first operating mode. This results in energy savings, giving the battery in a hearing aid a longer service life.

As previously mentioned, the rotary switch is fixed with its one section to the housing of the hearing aid device. In this way, the housing can be realized as an otoplastic, giving the hearing aid the levels of wearer comfort and acoustic comfort obtainable with conventional hearing aids.

BRIEF DESCRIPTION OF THE DRAWINGS

The present invention is displayed in more detail below with reference to the accompanying drawings, in which.

The exemplary embodiment illustrated in more detail below represents a preferred embodiment of the present invention.

DETAILED DESCRIPTION OF INVENTION

Figure 1:
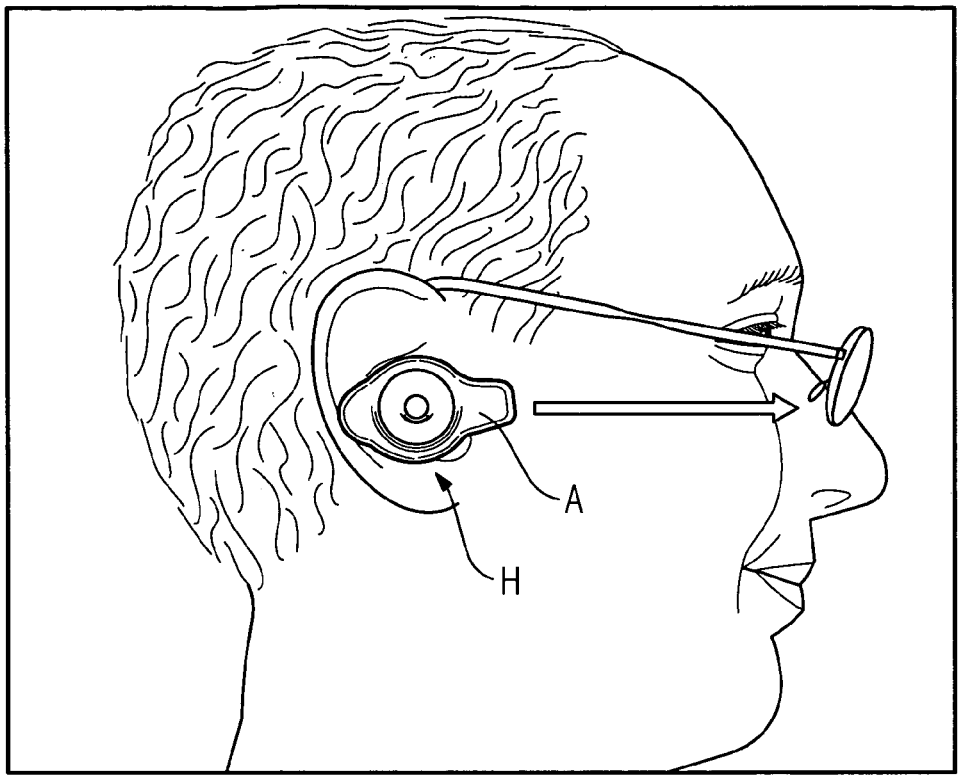
FIG. 1 shows a hearing aid device according to the invention when worn in the hearing aid mode.

Corresponding to FIG. 1, the hearing aid device H according to the invention is inserted into the auditory canal of a wearer in a similar manner to an in the ear hearing aid. A lug A, in which the directional microphone is accommodated, points horizontally forwards corresponding to the arrow indicated. The direction of the lug thereby corresponds to the highest sensitivity of the directional microphone. In this mode, the wearer first perceives the sound of a source, to which the wearer directs his view. This corresponds to the conventional hearing aid mode.

Figure 2:
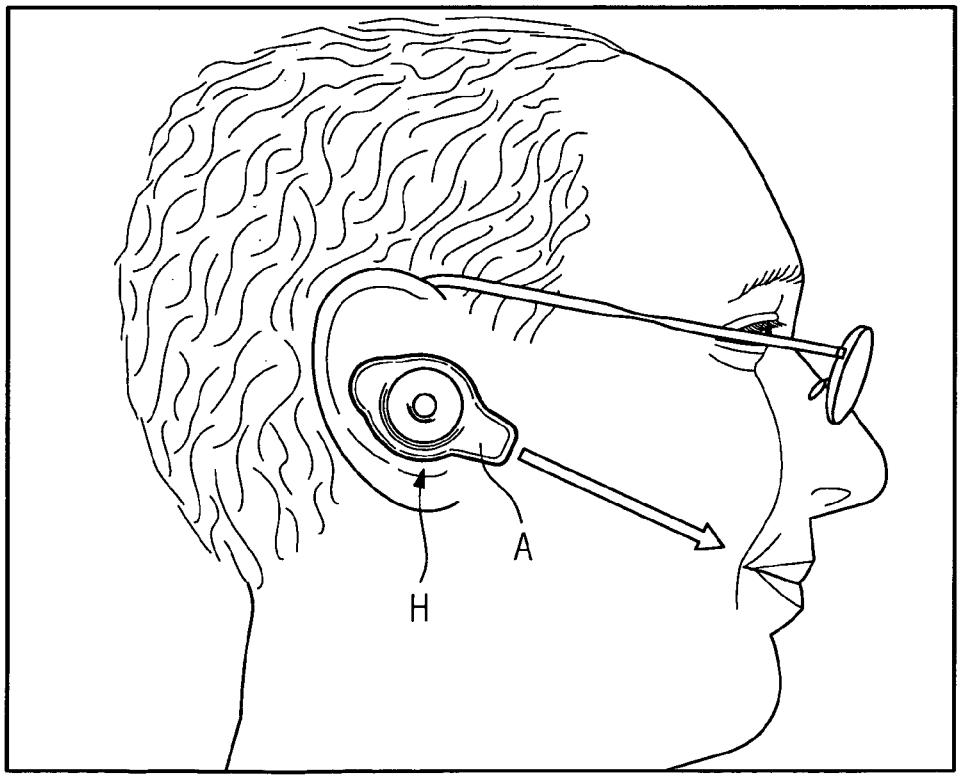
FIG. 2 shows the hearing aid in FIG. 1 in telephone mode.

If the wearer now has a telephone conversation, the voice signals of the wearer are initially to be recorded for transmission. Therefore in accordance with FIG. 2, the lug A of the hearing aid H is rotated corresponding to the arrow indicating towards the mouth of the wearer. The otoplastic in the auditory canal of the wearer thus does not change its position. The rotation of the lug A in relation to the otoplastic is guaranteed by means of a rotary switch. The rotation allows not only for the preferred direction of the directional microphone to be changed, but also for the switching from the hearing aid mode to the telephone mode. In this way, the transmission device for transmitting and receiving electrical and/or electromagnetic signals is switched on. Furthermore, the hearing aid is switched into the telephone operation, in which suitable filtering and amplifications are specifically carried out for telephone situations. The lug of the hearing aid device can also be rotated to accept the telephone conversation. To end the conversation, the wearer rotates the lug upwards.

In each application case, in other words, both in the hearing aid mode and in the telephone mode, the optimum directional characteristic is thus achieved, because the microphone lug A always points towards the relevant signal source. In addition, it is advantageous that the device is able to be operated simply and intuitively. Furthermore, no additional switch is required for accepting or ending a telephone conversation.

Figure 3:
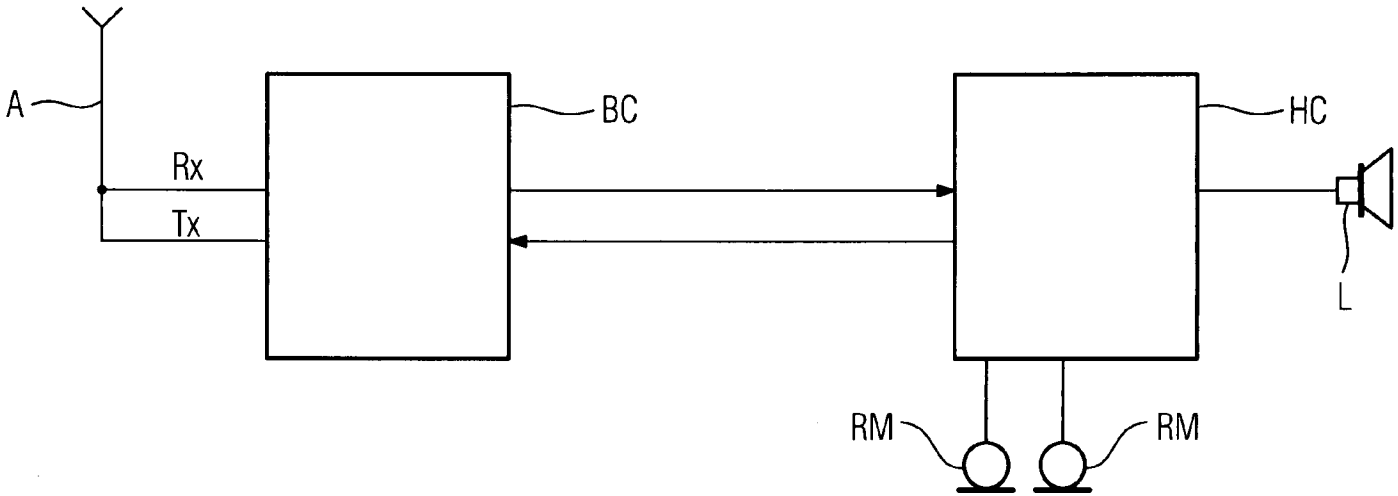
FIG. 3 shows a principle circuit diagram for the telephone mode.

FIG. 3 displays a principal circuit diagram of the hearing aid device in the telephone mode. A loudspeaker L and a directional microphone are connected to a hearing aid chip HC. The hearing aid chip HC is connected to a Bluetooth chip BC which is active in telephone mode, by means of a bidirectional data link. The Bluetooth chip BC sends and receives signals by way of antenna A. This configuration enables the wearer to receive via the loudspeaker L both the telephone signals from the Bluetooth chip BC and also his own voice signals via the directional microphone RM, processed with the individual frequency response of the hearing aid chip in each case.

Figure 4:
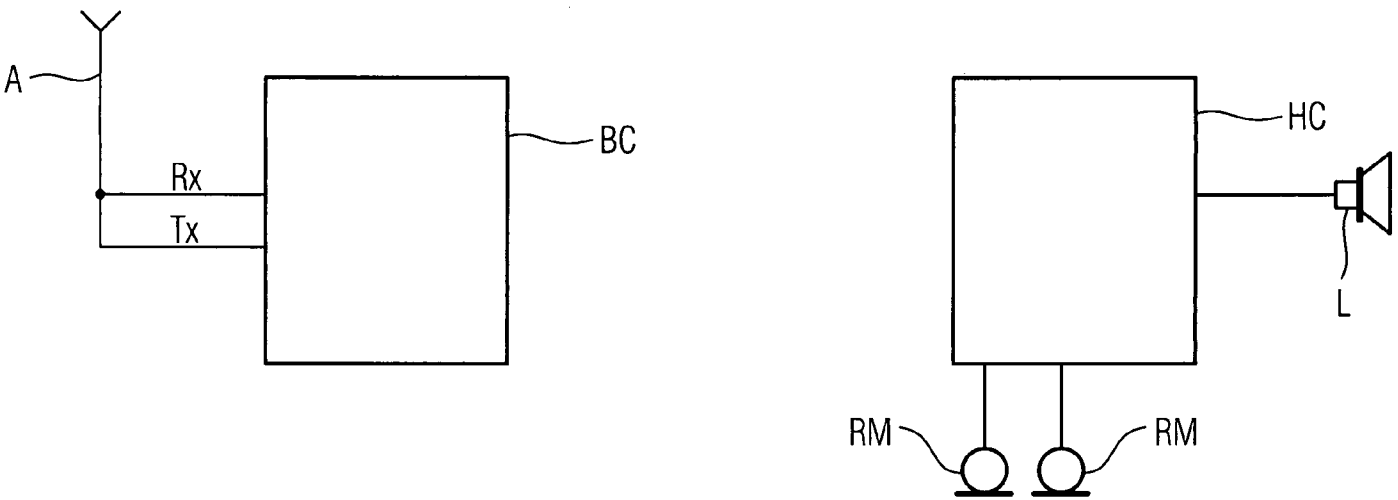
FIG. 4 shows a principle circuit diagram for the hearing aid mode.

If the wearer now switches to the hearing aid mode by rotating the lug on the rotary switch upwards, the Bluetooth chip BC is switched to inactive according to FIG. 4, so that the bidirectional connection between the two chips is interrupted. In this mode, the hearing aid device operates correspondingly as a pure hearing aid, whereby the acoustic signals recorded via the directional microphone are correspondingly processed in the hearing aid chip.

The invention claimed is:

1. A hearing aid device, comprising:

a housing for accommodating the hearing aid device;

a directional microphone device for acquiring sound signals;

a transmission device for electrically or electro-magnetically transmitting and receiving signals between the hearing aid device and an external device;

a hearing aid amplifier device having a first and a second operating mode and operatively connected to the directional microphone device, the hearing aid amplifier device configured to amplify directional microphone signals exclusively originating from the directional microphone device in the first operating mode and to amplify signals originating from the directional microphone device as well as signals transmitted from the transmission device in the second operating mode, wherein the directional microphone device is oriented in a horizontal position in the first operating mode, and wherein the directional microphone device is oriented at a downward angle in the second operating mode; and a rotary switch having a first switch section and a second switch section configured to be rotated relative to the first switch section;

wherein the housing is connected to the first switch section;

wherein the directional microphone device is connected to the second switch section such that a rotation of the second switch section relative to the first switch section enables a switching between the first and the second operating mode.

2. The hearing aid device according to claim 1, wherein the second operating mode is a telephone mode, the external device is a telephone, and the transmitted signals originate from the telephone.

3. The hearing aid device according to claim 1, wherein the transmission device includes a Bluetooth circuit.

4. The hearing aid device according to claim 1, wherein the housing comprises an otoplastic.

* * * * *